US010978262B2

(12) United States Patent
Browne et al.

(10) Patent No.: US 10,978,262 B2
(45) Date of Patent: Apr. 13, 2021

(54) REACH TOOL FOR USE IN LOW VOLTAGE APPLICATIONS

(71) Applicant: Otis Elevator Company, Farmington, CT (US)

(72) Inventors: Benjamin Alan Browne, Stuart, FL (US); Robert Rodriguez, Phoenix, AZ (US); Ryan N. Keane, Wilbraham, MA (US); Kevin J. Dix, Barrington, IL (US); Craig A. Buckley, Bloomfield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 199 days.

(21) Appl. No.: 16/160,681

(22) Filed: Oct. 15, 2018

(65) Prior Publication Data

US 2019/0118393 A1 Apr. 25, 2019

Related U.S. Application Data

(60) Provisional application No. 62/575,109, filed on Oct. 20, 2017.

(51) Int. Cl.

| | |
|---|---|
| ***B25B 9/00*** | (2006.01) |
| ***H01H 31/00*** | (2006.01) |
| ***B25G 3/20*** | (2006.01) |
| ***B25G 1/12*** | (2006.01) |
| ***B25G 1/04*** | (2006.01) |

(52) U.S. Cl.

CPC ..... *H01H 31/006* (2013.01); *B25B 9/00* (2013.01); *B25G 1/04* (2013.01); *B25G 1/12* (2013.01); *B25G 3/20* (2013.01)

(58) Field of Classification Search

CPC ..... H01H 31/006; H02G 1/02; H02G 1/04; B25J 1/04; A47F 13/06; B25G 1/04; B25G 1/12; B25G 3/20; B25B 9/00

USPC ..... 294/174, 209, 210, 24

See application file for complete search history.

(56) References Cited

U.S. PATENT DOCUMENTS

| | | | | |
|---|---|---|---|---|
| D28,940 | S | | 6/1898 | Miller |
| 854,578 | A | * | 5/1907 | Heath |
| 942,490 | A | | 12/1909 | Dunn |
| 1,724,435 | A | | 8/1929 | Studwell |
| 1,741,970 | A | | 12/1929 | Bodendieck |

(Continued)

FOREIGN PATENT DOCUMENTS

| | | |
|---|---|---|
| CN | 201678863 U | 12/2010 |
| CN | 201876505 U | 6/2011 |

(Continued)

OTHER PUBLICATIONS

European Patent Office, Extended European Search Report, Application No. 18201243.5-1019, dated Mar. 29, 2019 (9 pp.).

(Continued)

*Primary Examiner* — Dean J Kramer
(74) *Attorney, Agent, or Firm* — Cantor Colburn LLP

(57) ABSTRACT

A hot stick for manipulating a probe from a position a selected distance away from a workpiece, the tool including an arm, a connector coupled to the arm, the connector including a connector body having a contoured first surface, and a mechanism movable relative to the connector body and configured to cooperate with the first surface of the body to retain a probe.

16 Claims, 9 Drawing Sheets

(56) References Cited

U.S. PATENT DOCUMENTS

| | | | | |
|---|---|---|---|---|
| 1,744,356 | A | 1/1930 | Bodendieck | |
| 1,777,395 | A * | 10/1930 | Coon | H01R 11/14 294/174 |
| 1,920,168 | A | 8/1933 | Bodendieck | |
| 2,291,593 | A | 7/1942 | Hubbard | |
| 2,316,204 | A | 4/1943 | Williams | |
| 2,538,006 | A | 1/1951 | Keppler | |
| 2,868,051 | A | 1/1959 | Dupre et al. | |
| 3,182,960 | A | 5/1965 | French | |
| 3,473,837 | A | 10/1969 | Goodman | |
| 3,474,833 | A | 10/1969 | Garrette, Jr. et al. | |
| 3,863,145 | A | 1/1975 | Kelly et al. | |
| 4,004,834 | A | 1/1977 | Podpaly | |
| 4,047,821 | A | 9/1977 | Hoke et al. | |
| 4,079,978 | A | 3/1978 | McMullin | |
| D248,209 | S | 6/1978 | Holleman | |
| 4,132,441 | A | 1/1979 | Watkins | |
| 4,246,436 | A | 1/1981 | Hoffman et al. | |
| 4,470,328 | A | 9/1984 | Landis | |
| 4,525,006 | A * | 6/1985 | Nowak | H02B 3/00 294/106 |
| 4,582,352 | A * | 4/1986 | Filter | B25B 27/02 294/174 |
| 4,911,039 | A | 3/1990 | Lubbock et al. | |
| 5,171,052 | A | 12/1992 | Cunningham | |
| 5,299,464 | A | 4/1994 | Bennett | |
| D368,748 | S | 4/1996 | Kellersohn | |
| 5,531,494 | A * | 7/1996 | Singleton | B62H 7/00 280/204 |
| 5,593,196 | A | 1/1997 | Baum et al. | |
| 5,730,033 | A | 3/1998 | Mitrowski | |
| D396,392 | S | 7/1998 | Moskalik | |
| 6,283,519 | B1 | 9/2001 | Dutton et al. | |
| 6,450,557 | B1 | 9/2002 | Martinez | |
| 6,473,953 | B1 | 11/2002 | Portnoff | |
| 6,474,197 | B1 * | 11/2002 | Browen | H01H 85/0208 294/174 |
| 6,725,745 | B1 | 4/2004 | Palmieri | |
| D497,086 | S | 10/2004 | Lopes | |
| D500,433 | S | 1/2005 | Klaas | |
| D505,052 | S | 5/2005 | Dinh | |
| D522,326 | S | 6/2006 | Chance et al. | |
| 7,478,851 | B2 | 1/2009 | Geller | |
| D605,912 | S | 12/2009 | Gonzalez | |
| 7,721,459 | B2 | 5/2010 | Niles | |
| 7,909,376 | B1 | 3/2011 | McKinley | |
| 7,984,665 | B1 | 7/2011 | Robertson | |
| 8,056,445 | B2 | 11/2011 | Jackson, III | |
| 8,061,751 | B2 | 11/2011 | Hatcher | |
| D656,373 | S | 3/2012 | Martin | |
| 8,459,712 | B2 | 6/2013 | Thrasher | |
| 8,752,877 | B2 | 6/2014 | Spindler et al. | |
| D711,706 | S | 8/2014 | Votolato | |
| D719,423 | S | 12/2014 | Rowe | |
| D740,722 | S * | 10/2015 | Bennett | D12/133 |
| 9,380,857 | B2 | 7/2016 | Davis | |
| D772,027 | S | 11/2016 | Chi Man | |
| 9,656,381 | B2 | 5/2017 | Niles et al. | |
| 9,702,503 | B2 | 7/2017 | Chi Man | |
| 9,853,426 | B2 | 12/2017 | Hendricks | |
| 2005/0034884 | A1 | 2/2005 | Lee | |
| 2008/0265593 | A1 | 10/2008 | Woodworth | |
| 2011/0101716 | A1 | 5/2011 | Nolte et al. | |
| 2012/0284997 | A1 | 11/2012 | Morin et al. | |
| 2016/0190781 | A1 * | 6/2016 | Hendricks | H02G 1/04 294/132 |

FOREIGN PATENT DOCUMENTS

| | | | |
|---|---|---|---|
| CN | 104989932 | A | 10/2015 |
| CN | 204882795 | U | 12/2015 |
| CN | 106054033 | A | 10/2016 |
| CN | 106324295 | A | 1/2017 |
| CN | 206038873 | U | 3/2017 |
| DE | 20005517 | U1 | 2/2001 |
| GB | 2412346 | A | 9/2005 |

OTHER PUBLICATIONS

J. Harlen, Co., Lineman Tool Supply, [online]; [retrieved on Oct. 11, 2017]; retrieved from the Internet https://www.jharlen.com/p-11928-blue-stri pe-fiberglass-35ft-telescopic-measuring-stick.aspxJ. Harlen Co., Lineman Tool Supply, "Blue Stripe Fiberglass 35Ft Telescopic Measuring Stick," J. Harlen Co., Aug. 7, 2017, pp. 1-5.

Standard Electric Works Co., Ltd., [online]; [retrieved on Oct. 11, 2017]; retrieved from the Internet http://www.sew.com.tw/front/bin/ptlist.phtml?Category=435515 Standard Electric Works Co., Ltd., "SEW,Standard,Test,Measuring Instruments,Telescopic Hot Stick,Test Lead,Mini Appliance Checker," Standard Electric Works, Aug. 7, 2017, pp. 1-1.

Chinese Office Action; International Application No. 201811223799.5; International Filing Date: Oct. 19, 2018; dated Aug. 5, 2020; 8 pages.

Ex-Parte Quayle Action; U.S. Appl. No. 29/701,266, filed Aug. 9, 2019; dated Jun. 12, 2020; 14 pages.

* cited by examiner

REACH TOOL FOR USE IN LOW VOLTAGE APPLICATIONS

CROSS-REFERENCE TO RELATED APPLICATIONS

This application claims the benefit of U.S. Provisional Application Ser. No. 62/575,109 filed Oct. 20, 2017, which is incorporated herein by reference in its entirety.

BACKGROUND

The subject matter disclosed herein relates to person safety equipment, and more specifically, the disclosure relates to a hand held reach tool for use in electrical applications.

Hand-held electrical probes are known in the art for detecting the presence of AC signal potential on a conductor. One type of probe requires direct electrical contact with an uninsulated portion of the conductor. There is a safety risk associated with the contacting type probes due to the possibility that the user may receive a harmful electrical shock.

BRIEF DESCRIPTION

According to one embodiment, a hot stick for manipulating a probe from a position a selected distance away from a workpiece, the tool including an arm, a connector coupled to the arm, the connector including a connector body having a contoured first surface, and a mechanism movable relative to the connector body and configured to cooperate with the first surface of the body to retain a probe.

In addition to one or more of the features described above, or as an alternative, in further embodiments the hot stick is suitable for use in applications where the workpiece has 1000 volts or less.

In addition to one or more of the features described above, or as an alternative, in further embodiments the hot stick is suitable for use in applications where the workpiece has 600 volts or less.

In addition to one or more of the features described above, or as an alternative, in further embodiments the arm is a telescoping arm comprising a plurality of sections movable between a retracted position and an extended position.

In addition to one or more of the features described above, or as an alternative, in further embodiments a resilient locking mechanism retains the arm in one of the extended position and the retracted position.

In addition to one or more of the features described above, or as an alternative, in further embodiments a gripping material is positioned adjacent a first end of the arm.

In addition to one or more of the features described above, or as an alternative, in further embodiments the arm, connector, and mechanism are formed from a non-conductive material.

In addition to one or more of the features described above, or as an alternative, in further embodiments the mechanism is slidable within a channel formed in the connector body, the mechanism being selectively retained at a plurality of locations relative to the connector body.

In addition to one or more of the features described above, or as an alternative, in further embodiments the mechanism includes an engagement portion located generally adjacent the first surface of the connector body, at least one of the engagement portion and the first surface having an insert for gripping the probe coupled thereto.

In addition to one or more of the features described above, or as an alternative, in further embodiments the mechanism is a strap having at least one end removably coupled to the connector body.

In addition to one or more of the features described above, or as an alternative, in further embodiments the strap is formed from a Velcro material.

In addition to one or more of the features described above, or as an alternative, in further embodiments the connector body includes an elongated member operable to translate a button along an axis.

In addition to one or more of the features described above, or as an alternative, in further embodiments the connector body includes at least one feature operable to rotate a button about an axis.

In addition to one or more of the features described above, or as an alternative, in further embodiments the at least one feature includes a substantially identical first feature and second feature, the first feature and the second feature being generally symmetrical about a corresponding surface of the connector body.

In addition to one or more of the features described above, or as an alternative, in further embodiments the second feature is rotated 180 degrees relative to the first feature.

In addition to one or more of the features described above, or as an alternative, in further embodiments a clearance is defined between the first feature and the second feature, the clearance being complementary to a channel of the button.

In addition to one or more of the features described above, or as an alternative, in further embodiments the button is an inspection button of an elevator.

In addition to one or more of the features described above, or as an alternative, in further embodiments the connector is fixedly attached to an end of the arm.

In addition to one or more of the features described above, or as an alternative, in further embodiments the connector is integrally formed with an end of the arm.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Referring now to the FIGS., an example of tool 20 commonly referred to as a "hot stick" is illustrated. The tool 20 is configured to allow a user to manipulate a piece of equipment from a selected distance away from a workpiece. For example, in an embodiment, the tool 20 may be suitable for electrical use up to 600 volts per ASTM and CSA standards. Alternatively, the tool may be suitable for electrical use up to 750 or 1000 volts.

Figure 1:
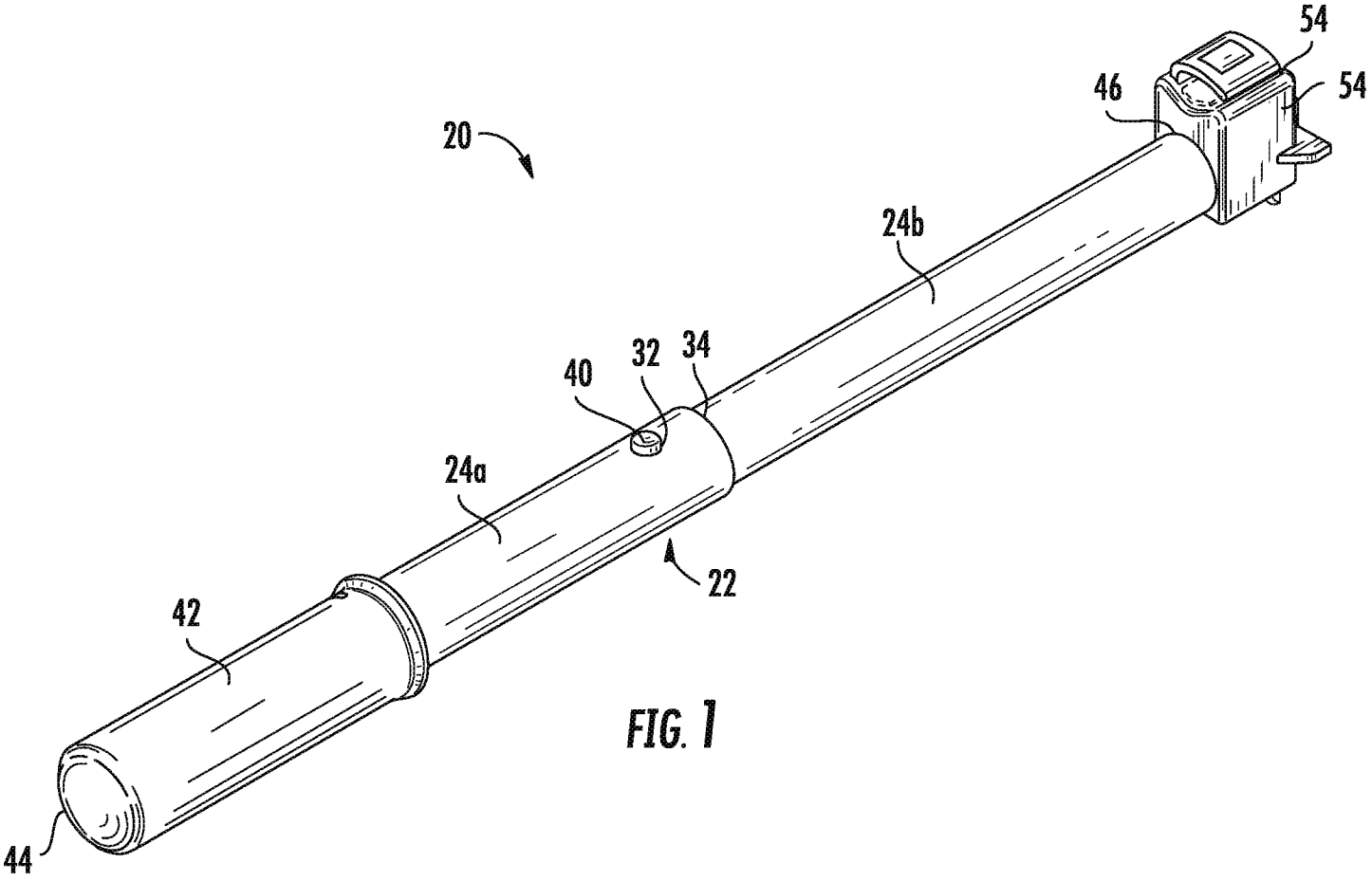
FIG. 1 is a perspective view of a hot stick according to an embodiment.
Figure 2:
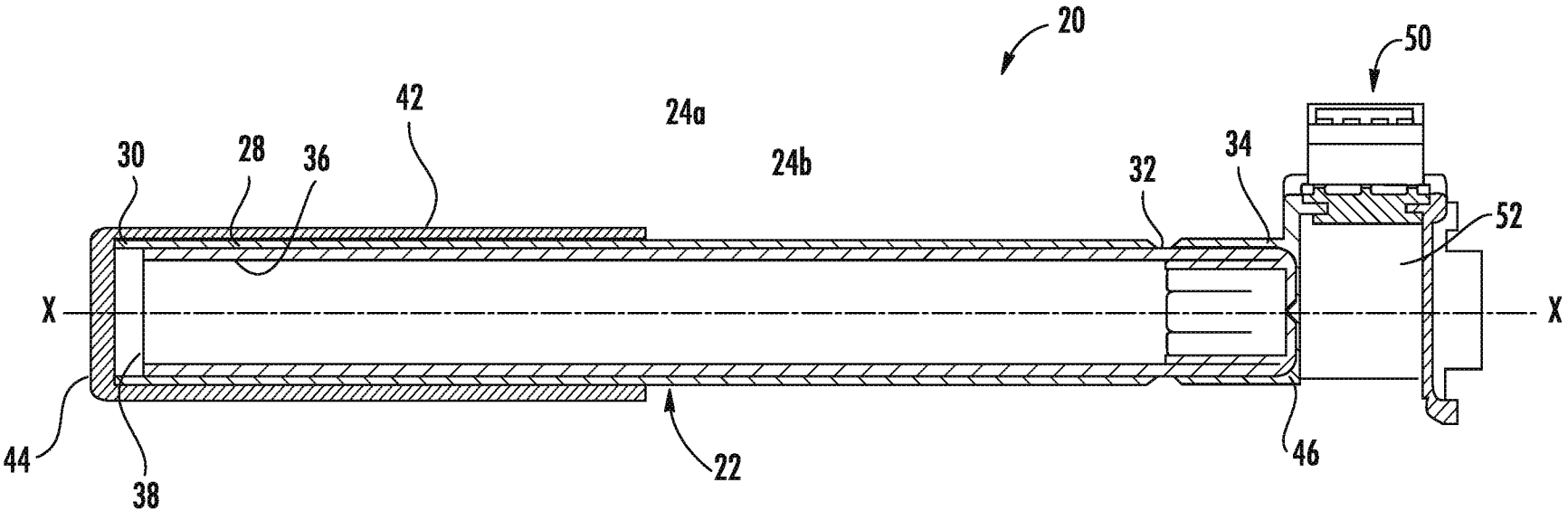
FIG. 2 is a cross-sectional view of the hot stick of FIG. 1 in a retracted configuration according to an embodiment.
Figure 3:
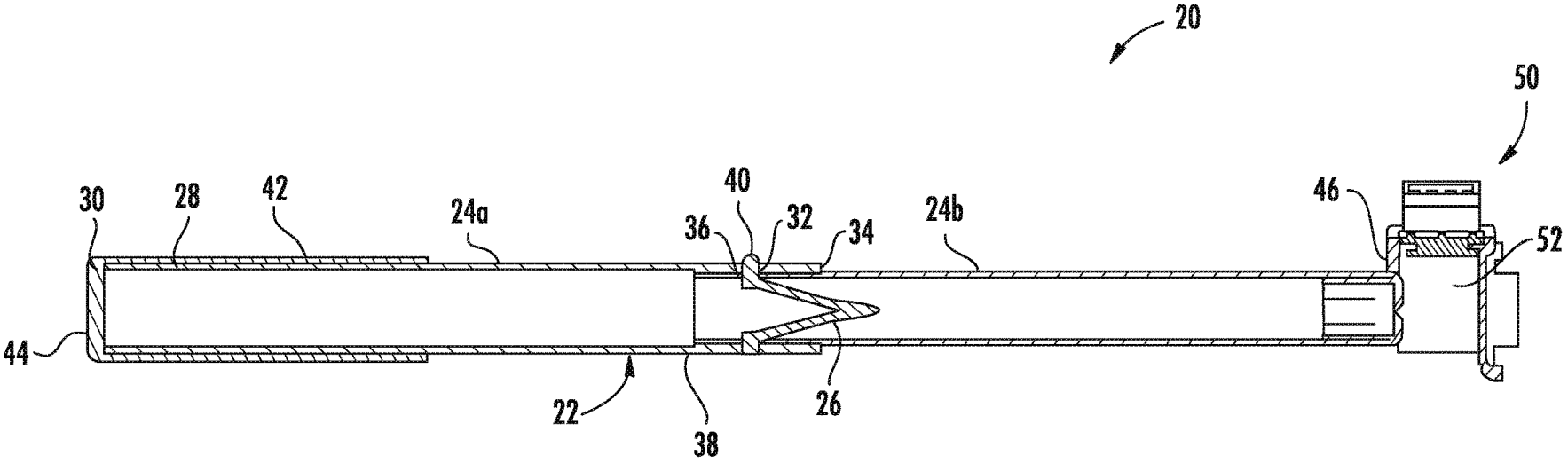
FIG. 3 is a cross-sectional view of the hot stick of FIG. 1 in an extended configuration according to an embodiment.

As shown, the tool 20 includes a telescoping arm 22 having a plurality of tubular sections 24 slidable along a longitudinal axis X of the tool 20 to vary the length thereof. In the illustrated, non-limiting embodiment, the arm 22 includes a first tubular section 24*a* and a second tubular section 24*b* movable between a retracted position (FIG. 2) and an extended position (FIG. 3). Although an arm 22 having only two tubular sections 24*a*, 24*b* is illustrated and described herein, it should be understood that an arm 22 having any number of sections 24 is within the scope of the disclosure. An outer diameter of the second tubular section 24*b* is smaller than an inner diameter of the first tubular section 24*a* such that all or a portion of the second tubular section 24*b* is receivable within a hollow interior of the first tubular section 24*a*. Accordingly, in the retracted position, all or a substantial portion of the first tubular section 24*a* and the second tubular section 24*b* are arranged in an overlapping configuration.

A locking mechanism 26 is operable to lock the arm 22 in one or more of the extended and retracted positions. The first tubular section 24*a* has a first hole 28 formed adjacent a first end 30 and a second hole 32 formed adjacent the second, opposite end 34. Similarly, the second tubular section 24*b* has a hole 36 formed adjacent a first end 38 thereof. When the arm 22 is in the retracted position, the first holes 28, 36 of the first and second tubular sections 24*a*, 24*b* are generally aligned such that the locking mechanism 26 engages the first holes 28, 36. Through this engagement, the second tubular section 24*b* is restricted from moving relative to the first tubular section 24*a*. In the extended position, the locking mechanism 26 engages the aligned first hole 36 of the second tubular section 24*b* and the second hole 32 of the first tubular section 24*a* to restrict relative movement between the first and second tubular sections 24*a*, 24*b*. In the extended position, the length of the arm 22 in combination with a user's arm is equal to or greater than a shock protection boundary set by industry electrical standards, such as NFPA 70E, for example. In an embodiment, the arm 22 has a length greater than or generally equal to about 21 inches in the extended position, and may be retracted to a length of between about 12 and 13 inches.

The locking mechanism 26 is a resilient member, such as a clip mounted to the second tubular section 24*b* for example, having at least one protrusion or detent 40 receivable within the holes 28, 32, 36. A biasing force of the locking mechanism 26 biases the detent 40 outwardly and into engagement with one or more holes 36, and 28 or 32. When the detent 40 is engaged with a pair of aligned holes, the locking mechanism 26 may be able to withstand at least three pounds of shear force applied to the tubular sections 24*a*, 24*b* of the arm 22.

To disengage the locking mechanism 26 from a hole 28 or 32 of the first arm section 24*a*, an inward force is applied thereto. When the detent 40 is disengaged from a hole 28 or 32 of the first tubular section 24*a*, the arm 22 is movable between the extended and retracted position. Although the arm 22 is described as telescoping, embodiments where the arm 22 is formed having a stationary length are also within the scope of the disclosure. Further, regardless of the configuration, the arm 22 is formed from a suitable non-conductive material, such as plastic for example. The arm may additionally include a coating to prevent great and dirt from accumulating thereon.

A material 42 intended to provide a surface for easily gripping the arm 22 is wrapped about at least a portion of the arm 22. Although the gripping material 42 is illustrated as being located at a first end 44 of the arm, adjacent the first end 30 of the first tubular section 24*a*, and has a length equal to about 6 inches, embodiments where the gripping material 42 spans an entire length of the first tubular section 24*a* or of the entire arm 22 are also within the scope of the disclosure. In an embodiment, the material 42 is a rubberized or foam material. However, any suitable non-conductive material is contemplated herein.

Located at the distal end 46 of the arm 22, opposite the gripping material 42, is a connector 50. The connector 50 may be removably coupled to or fixedly attached to the arm 22. As shown, the body 52 of the connector 50 is generally rectangular in shape. However, any suitable shape is within the scope of the disclosure. A first surface 54 of the connector 50 includes a generally non-planar surface. In an embodiment, the contour of the first surface 54 is generally complementary to a probe or other device 56 (see FIG. 5) to be used with the tool 20. Examples of probes or other devices 56 suitable with the tool 20 include, but are not limited to, a proximity tester and a meter probe for example.

The connector 50 additionally includes a mechanism 58 configured to cooperate with the body 52 to retain or hold the probe or other device 56. In the non-limiting embodiment of FIGS. 1-7, the mechanism 58 includes an engagement portion 60 disposed adjacent the first surface 54. The engagement portion 60 may also, but need not, have a contour generally complementary to a portion of the probe or other device 56. In an embodiment, one or both of the first surface 54 and the engagement portion 60 includes an insert 62 having an enhanced gripping surface for preventing movement of a device in contact therewith.

Figure 5:
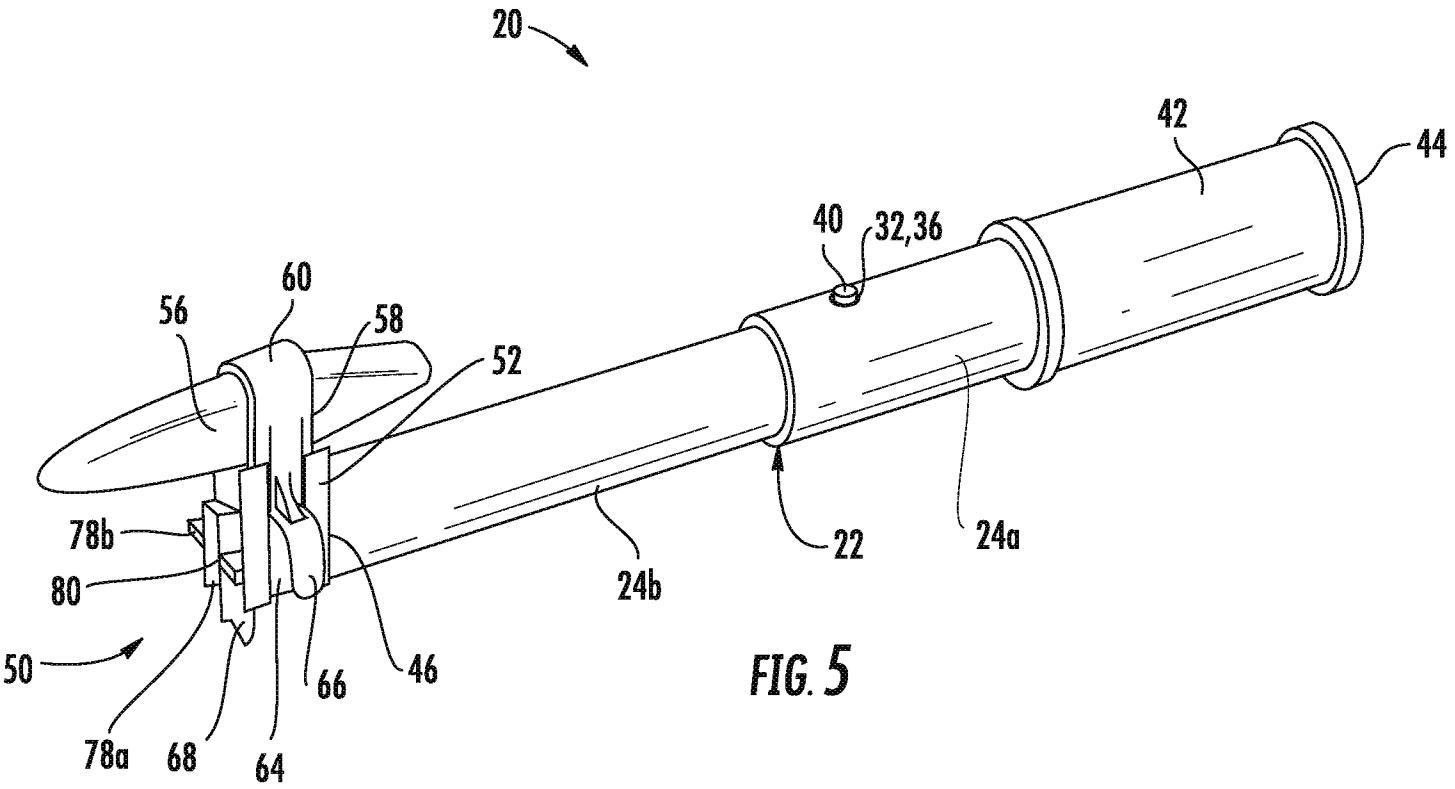
FIG. 5 is a perspective view of a hot stick having a probe mounted thereto according to an embodiment.

The mechanism 58 is movable to compress the device 56 between the first surface 54 and the engagement portion 60 thereof, best shown in FIG. 5. The mechanism 58 in combination with the connector 50 is suitable to retain a variety of devices 56 even when a force of up to three pounds is applied thereto in all directions. In the illustrated, non-limiting embodiment, the mechanism 58 is movable about an axis Y oriented substantially perpendicular to the longitudinal axis X of the arm 22. However, embodiments where the arm 22 is movable about an axis parallel to the longitudinal axis X or is rotatable about an axis for example, are also within the scope of the disclosure.

In the illustrated, non-limiting embodiment, the mechanism 58 is slidable within a channel 64 formed at a side of the connector 50 to position the engagement portion 60 relative to the first surface 54. The mechanism 58 may function in a manner similar to a ratchet such that the mechanism 58 is held or selectively retained at one of a plurality of positions relative to the connector body 52. The mechanism 58 may include a tab or other feature 66 to allow a user to easily manipulate the position of the mechanism 58 relative to the connector body 54.

Figure 9:
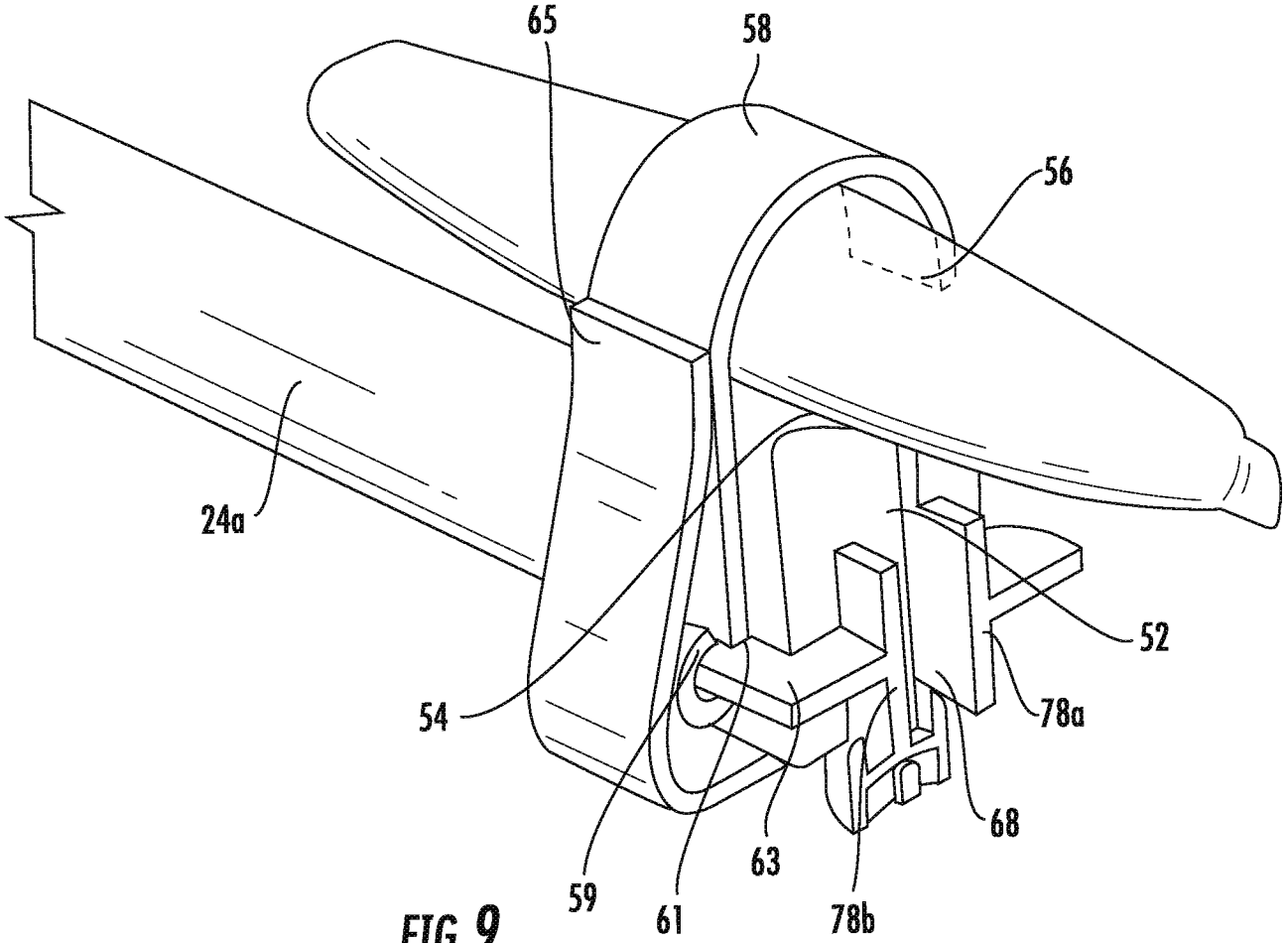
FIG. 9 is a perspective view of portion of a hot stick having a probe mounted thereto according to an embodiment.

In another embodiment, best shown in FIG. 9, the movable mechanism 58 includes a strap coupled to the body 52 of the connector 50. For example, a first end 59 of the strap may extend through a slot 61 formed in the body 52, such as in a flange 63 extending from a side thereof. The strap 58 is configured to wrap around the probe or other device 56 to compress the device 56 between the first surface 54 and the mechanism 58. The movable or free end 65 of the strap 58 may be configured to removably couple to a portion of the connector 50, or alternatively, may couple to another portion of the strap 58, as shown in the FIG. In an embodiment, the strap 58 is formed from a Velcro material; however any suitable strap-like mechanism is contemplated herein.

Figure 6:
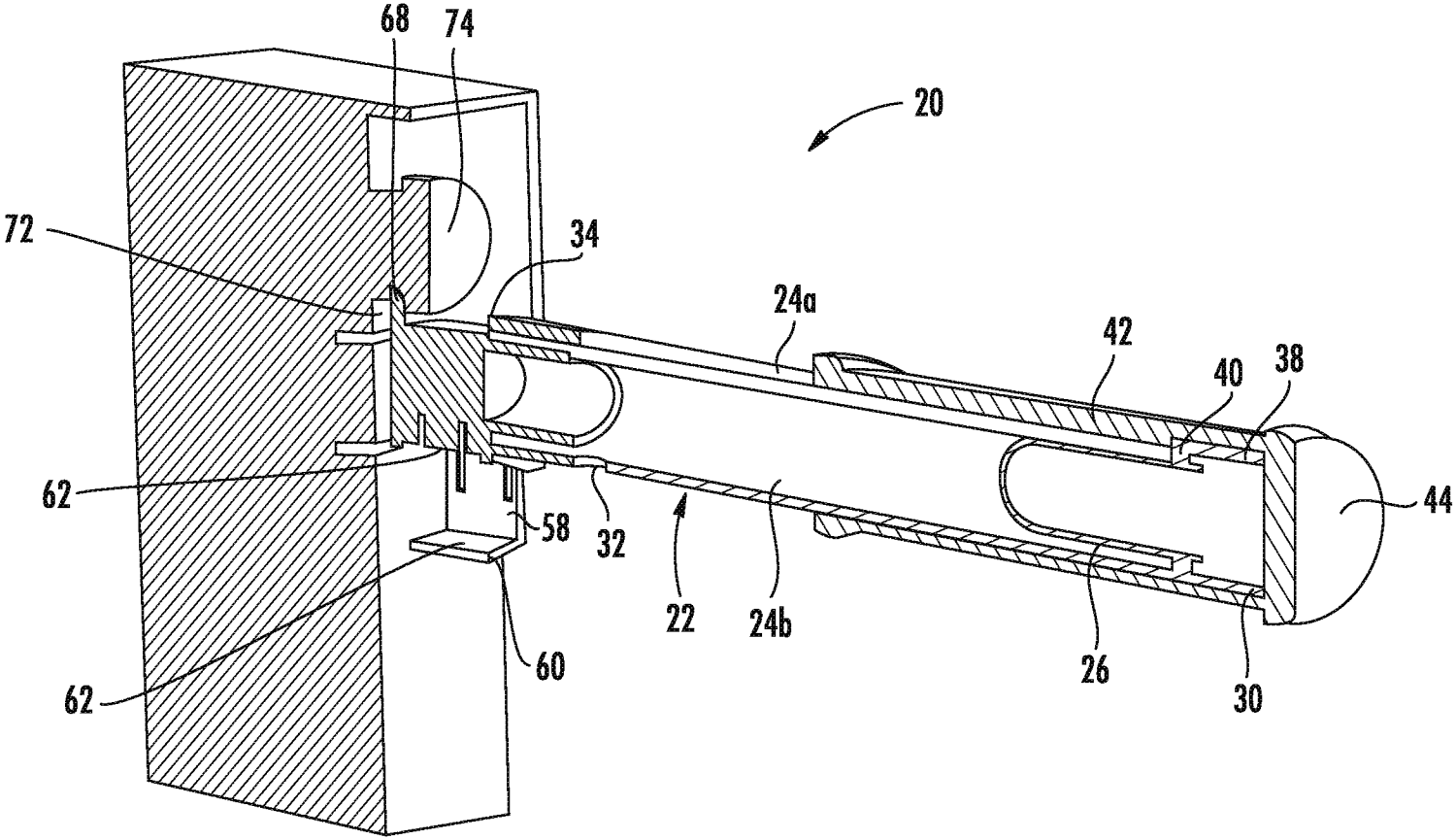
FIG. 6 is a perspective cross-sectional view of a hot stick according to an embodiment.

The tool 20 may additionally be adapted to manipulate one or more buttons. In such embodiments, an elongated member 68 may extend from a surface of the connector body 52. Although the elongated member 68 is illustrated as being positioned at a surface 70 of the connector body 52 opposite the portion of the connector 50 mounted to the arm 22, the elongated member 68 may be disposed at any location about the connector 50. As best shown in FIG. 6, the thickness of the elongated member 68 is sized such that the elongated member 68 may be inserted between a mounting surface 72 and a button 74 movable axially towards and away from the plane of the mounting surface 72. Accordingly, the elongated member 68 may be used to push or pull the button 74 in a desired direction.

Figure 4:
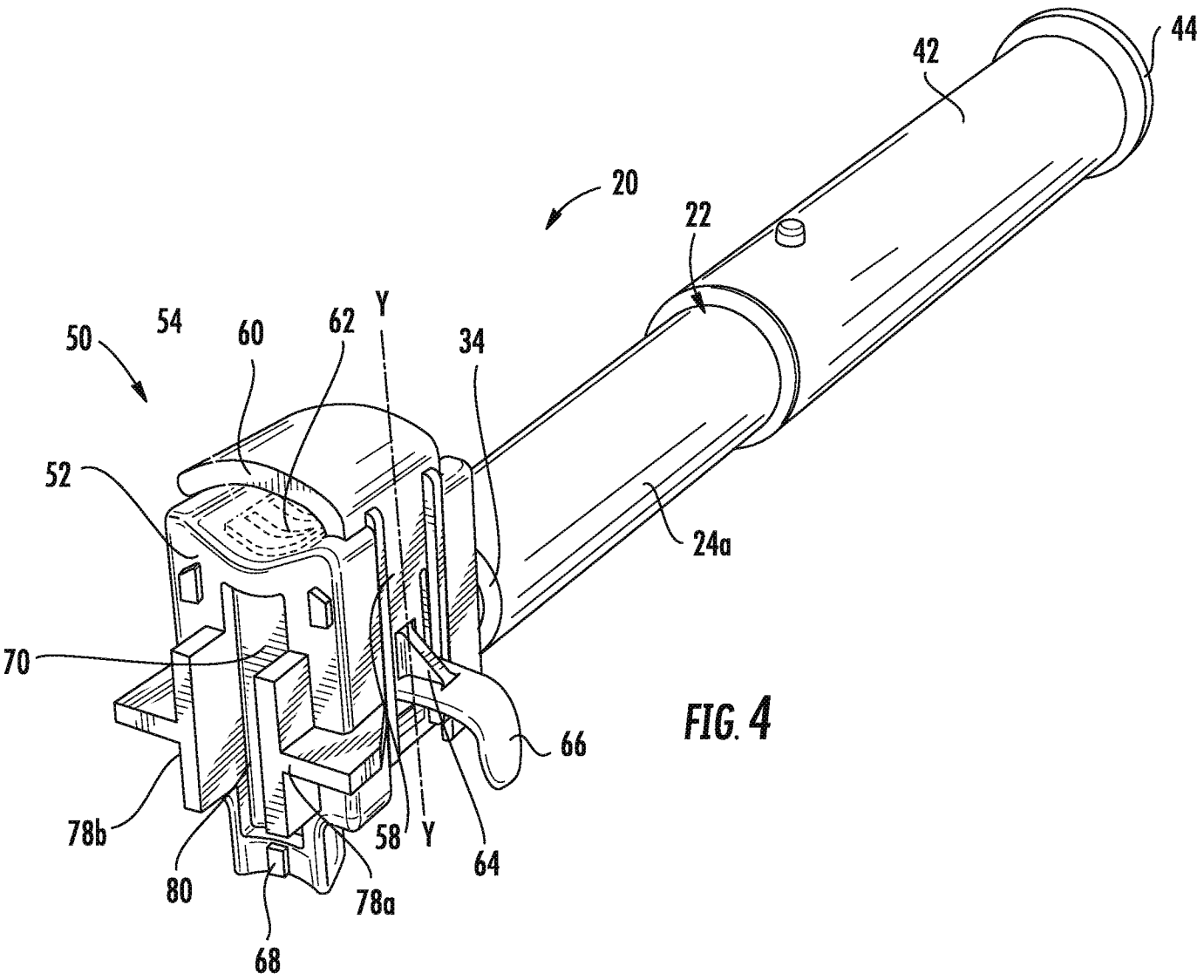
FIG. 4 is another perspective view of a hot stick according to an embodiment.
Figure 7:
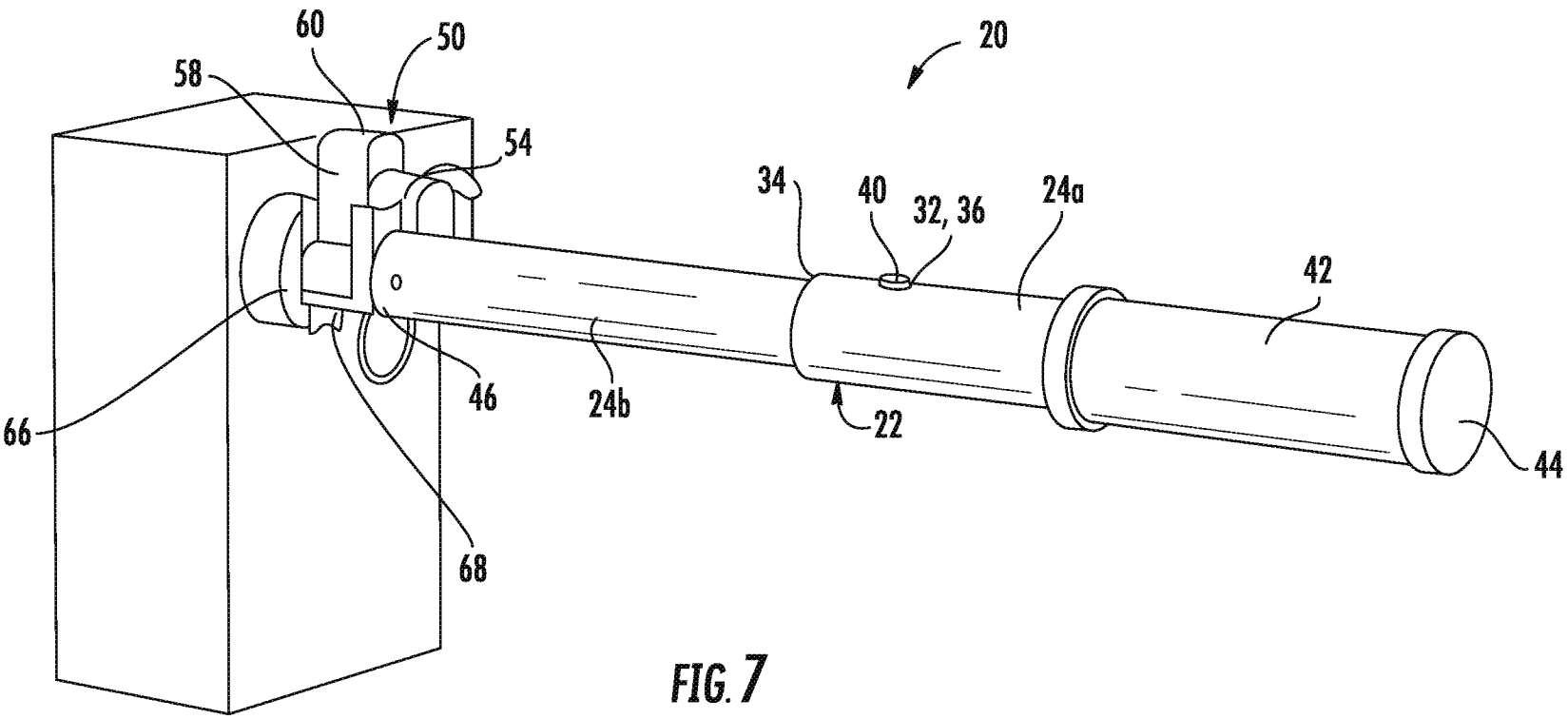
FIG. 7 is a perspective view of a hot stick according to another embodiment.

In an embodiment, the tool 20 is adapted for use in elevator applications. In such embodiments, the connector 50 includes at least one feature 78 configured to engage and facilitate rotation of a corresponding button or knob 76, such as a button for controlling operation of the elevator car in an inspection mode for example. With reference to FIGS. 4 and 7, in the illustrated, non-limiting embodiment, the connector body 52 includes a first feature 78*a* and a substantially identical second feature 78*b*. However, any number of features is contemplated herein. The features are rotated 180 degrees relative to one another such that the features are generally symmetrical about the corresponding surface 70 of the connector body 52. In embodiments where a shroud surrounds the button, as shown in FIG. 7, the diameter defined by the plurality of features 78 is less than the diameter of the shroud for receipt therein. However, the features 78 may act to stabilize the tool 20 when being used in other applications. For example, the diameter defined by the features 78 may exceed a shroud associated with another button, such as a run button of an elevator control, thereby preventing accidental engagement with the button.

Figure 8:
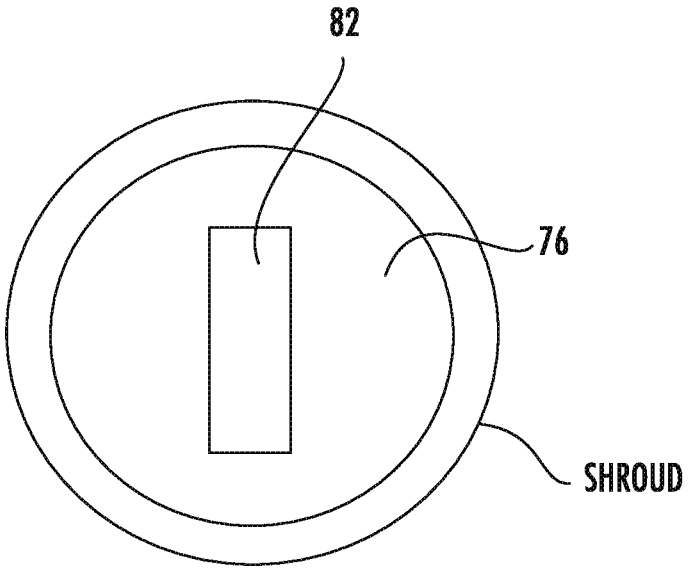
FIG. 8 is a front view of a button having a channel feature according to an embodiment.

In the illustrated, non-limiting embodiment, the first and second features 78*a*, 78*b* are horizontally oriented, generally T-shaped members that define a channel or clearance 80 there between. The channel 80 is complementary to a channel 82 formed in and protruding from the button 76 (see FIG. 8). In use, a user can position the tool 20 such that the channel 82 of the button 76 is received within the channel 80 formed between the features 78*a*, 78*b*. Once aligned, the user may rotate the tool 20 in a desired direction to turn the button 76. It should be understood that the features 78 illustrated and described herein are specific to one type of button and that features having another configuration adapted for use with a different type of button are also within the scope of the disclosure.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A hot stick for manipulating a probe from a position a selected distance away from a workpiece, the tool comprising:

an arm;

a connector coupled to the arm, the connector including a connector body having a contoured first surface; and a mechanism mounted at an exterior surface the connector body, the mechanism being movable relative to the connector body to cooperate with the first surface to retain a probe, the mechanism being slidable within a channel formed in the connector body and extending generally perpendicular to a longitudinal axis of the arm, the mechanism being selectively retained at a plurality of locations relative to the connector body.

2. The hot stick of claim 1, wherein the hot stick is suitable for use in applications where the workpiece has 1000 volts or less.

3. The hot stick of claim 1, wherein the hot stick is suitable for use in applications where the workpiece has 600 volts or less.

4. The hot stick of claim 1, wherein the arm is a telescoping arm comprising a plurality of sections movable between a retracted position and an extended position.

5. The hot stick of claim 4, wherein a resilient locking mechanism retains the arm in one of the extended position and the retracted position.

6. The hot stick of claim 1, wherein a gripping material is positioned adjacent a first end of the arm.

7. The hot stick of claim 1, wherein the arm, connector, and mechanism are formed from a non-conductive material.

8. The hot stick of claim 1, wherein the mechanism includes an engagement portion located generally adjacent the first surface of the connector body, at least one of the engagement portion and the first surface having an insert for gripping the probe coupled thereto.

9. The hot stick of claim 1, wherein the connector body includes an elongated member operable to translate a button along an axis.

10. The hot stick of claim 9, wherein the button is an inspection button of an elevator.

11. The hot stick of claim 1, wherein the connector body includes at least one feature operable to rotate a button about an axis.

12. The hot stick of claim 11, wherein the at least one feature includes a substantially identical first feature and second feature, the first feature and the second feature being generally symmetrical about a corresponding surface of the connector body.

13. The hot stick of claim 12, wherein the second feature is rotated 180 degrees relative to the first feature.

14. The hot stick of claim 12, wherein a clearance is defined between the first feature and the second feature, the clearance being complementary to a channel of the button.

15. The hot stick of claim 1, wherein the connector is fixedly attached to an end of the arm.

16. The hot stick of claim 1, wherein the connector is integrally formed with an end of the arm.

* * * * *